United States Patent [19]

Sciscoe

[11] Patent Number: 4,866,427

[45] Date of Patent: Sep. 12, 1989

[54] TEMPERATURE ALARM FOR STOVES

[76] Inventor: Alfred L. Sciscoe, 803 Park Square Dr., Bloomington, Ind. 47403

[21] Appl. No.: 248,925

[22] Filed: Sep. 26, 1988

[51] Int. Cl.[4] ..... G08B 17/06

[52] U.S. Cl. ..... 340/594; 374/147

[58] Field of Search ..... 340/594, 593, 584, 693; 374/147, 148

[56] References Cited

U.S. PATENT DOCUMENTS

| | | | |
|---|---|---|---|
| 2,302,640 | 11/1942 | Schmidt | 374/147 |
| 2,743,334 | 4/1956 | Valenti . | |
| 2,799,850 | 7/1957 | Thomas . | |
| 2,804,773 | 9/1957 | Domingo et al. | 374/147 |
| 2,907,992 | 10/1959 | Bronikowski . | |
| 4,075,614 | 2/1978 | White | 340/693 |
| 4,305,289 | 12/1981 | Cornelison . | |
| 4,575,258 | 3/1986 | Wall | 374/147 |
| 4,636,776 | 1/1987 | Leaming . | |
| 4,712,095 | 12/1987 | Georgis . | |

*Primary Examiner*—Reinhard J. Eisenzopf
*Assistant Examiner*—Maura K. Regan
*Attorney, Agent, or Firm*—Craig A. Wood

[57] ABSTRACT

A temperature alarm is disclosed for attachment around the exterior of the flue pipe of a wood-burning or similar stove, with alarm activation temperature selected by slidable adjustment along the flue pipe. A bimetal thermostat is mounted in close proximity to the flue pipe, and acts to close an electrical connection between thermally protected power supply and acoustic horn. A system test circuit is provided.

19 Claims, 1 Drawing Sheet

TEMPERATURE ALARM FOR STOVES

BACKGROUND OF THE INVENTION

1. Field of the Invention

The present invention generally relates to temperature activated alarms, and more particularly to temperature alarms for use with woodburning and similar stoves that utilize a cylindrical flue pipe, which provide an acoustic alarm in response to flue pipe temperature in excess of a predetermined level.

2. Description of the Prior Art

As the number of woodburning stoves in use has increased, the frequency of flue and chimney fires has risen dramatically. In many instances, the occurrence of a chimney or flue fire can be directly traced to the buildup and subsequent ignition of creosote deposits in the flue pipe. Notwithstanding the requirements of local building codes, it is not unusual for an overheated stove to ignite nearby walls and other materials. In addition, severe injury may be incurred by persons accidentally coming in contact with and overheated stove. Unless a wood stove is closely and continuously monitored, a stove may overheat and become a threat to life and property in a short period of time.

Temperature alarms for use with woodburning and similar stoves are well known, and typically utilize a sensor unit magnetically or physically attached to the flue pipe, a remote alarm unit, and a bimetal thermostat, as disclosed, for example, by U.S. Pat. Nos. 4,636,776 and 4,712,095. In addition, U.S. Pat. No. 4,305,289 discloses a bimetal, flue pipe mounted thermometer for use with woodburning and similar stoves.

Despite the availability of such devices, there exists a need in the art for a temperature alarm for stoves that is self-contained, compact and eliminates the need for a remote alarm unit, yet is sturdy, inexpensive to produce, adaptable for use with a wide variety of existing woodburning and similar stoves, and easily adjustable with respect to the temperature at which the alarm is activated. In addition, there exists a need in the art for a temperature alarm for stoves that does not rely upon magnetic attraction for attachment to the stove, as demagnetization and loss of attachment may occur as the Curie temperature is reached, and as flue pipes of low magnetic susceptibility increase in popularity.

SUMMARY OF THE INVENTION

In order to aid in the understanding of the present invention, it can be stated in essentially summary form that it is directed to a temperature alarm for stoves that is capable of adjustable attachment to the exterior of flue pipes of existing woodburning and similar stoves, and produces an acoustic alarm upon completion of a thermostatically controlled electrical circuit. A bimetal thermostat is mounted in close proximity to the exterior surface of a heat conductive cylindrical band slidably attached to the exterior of the flue pipe. A thermally shielded acoustic alarm and power supply are mounted at the distal end of an extension arm attached exterior to, coplanarly with and normal to the cylindrical band.

Accordingly, it is an object of the present invention to provide a temperature alarm for stoves that may be used with a wide variety of existing stoves having cylindrical flue pipes, without modification to the stove.

It is another object of the present invention to provide a temperature alarm for stoves that is easily adjusted for activation temperature.

It is another object of the present invention to provide a temperature alarm for stoves that is capable of operation in a sustained high temperature environment without requiring a remote alarm unit.

It is another object of the present invention to provide a temperature alarm for stoves that is economical to produce.

It is still another object of the present invention to provide a temperature alarm for stoves that has a self-contained power supply.

It is yet another object of the present invention to provide a temperature alarm for stoves that has easily maintained and replaced components.

Further objects and advantages of the present invention will be apparent from a study of the following portion of the specification, the claims, and the attached drawings.

DESCRIPTION OF THE PREFERRED EMBODIMENT

Figures 1, 2, 3:
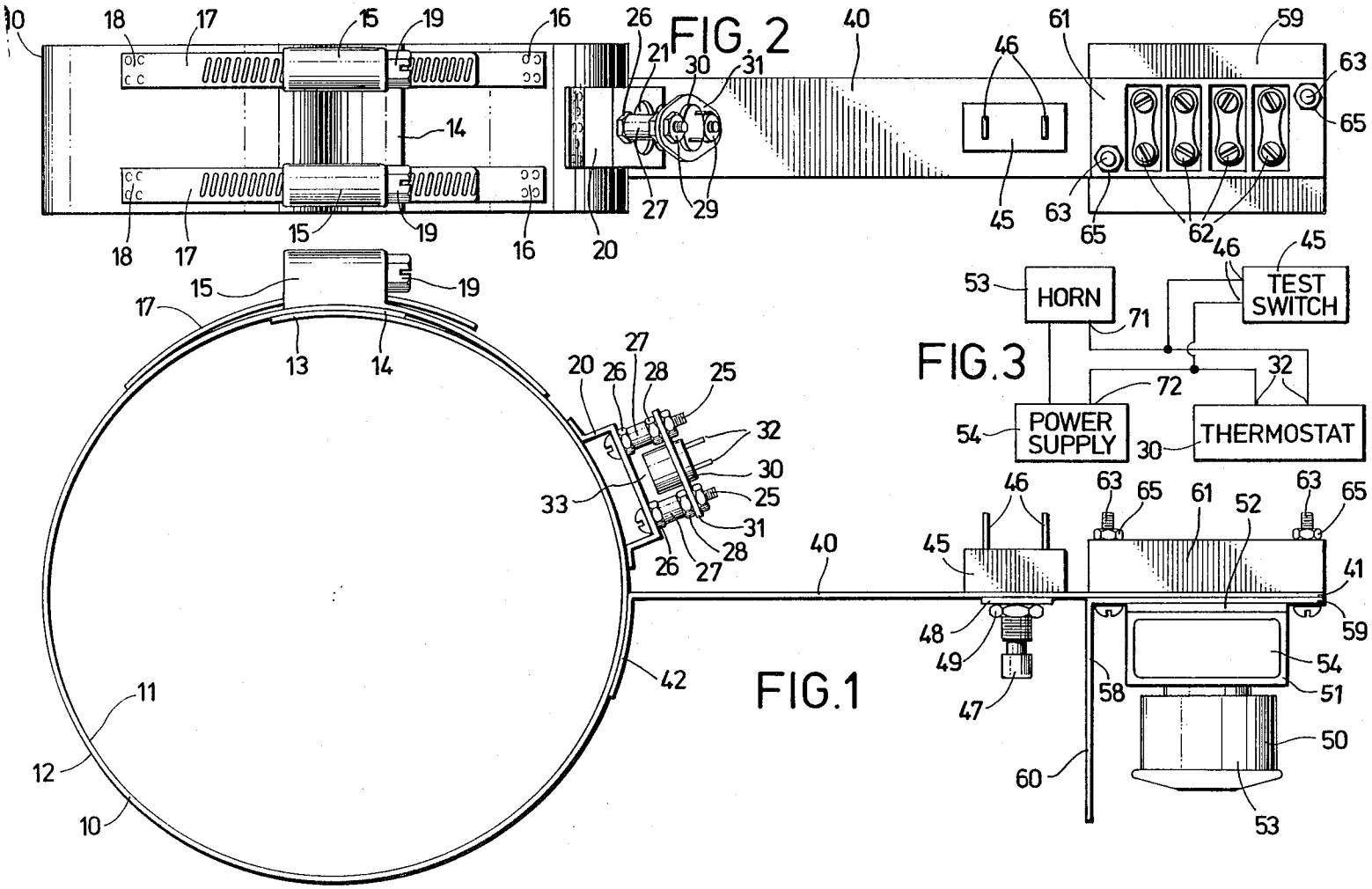
FIG. 1 is a top plan view, without electrical connections, of a temperature alarm for stoves embodying the present invention.
FIG. 2 is a side elevational view, without electrical connections, of a temperature alarm for stoves embodying the present invention.
FIG. 3 is an electrical schematic of a temperature alarm for stoves embodying the present invention.

The following portion of the specification, taken in conjunction with the drawings, sets forth the preferred embodiment of the present invention. The embodiment of the invention disclosed herein is the best mode contemplated by the inventor for carrying out his invention in a commercial environment, although it should be understood that various modifications can be accomplished within the parameters of the present invention.

Referring now to the drawings for a detailed description of the present invention, reference is first made to FIGS. 1 and 2, showing band 10 formed of a heat conductive, sturdy and durable material such as stainless steel, having interior surface 11, exterior surface 12, first end 13 and second end 14, generally circularly disposed around a flue pipe (not shown) of a wood-burning or similar stove (not shown), with first end 13 and second end 14 overlapping. Worm drive band fastener female ends 15 are disposed coplanarly with band 10 and proximate to first end 13, and are attached to exterior surface 12 at female end attachment points 16. Worm drive band fastener male ends 17 are similarly attached to exterior surface 12 at male end attachment points 18 proximate to second end 14 and are disposed to mesh with worm drive band fastener female ends 15. In this manner, as fastener screws 19 are rotated, worm drive band fastener male ends 17 advance through worm drive band fastener female ends 15 and the effective circumference of band 10 is progressively reduced until the desired degree of attachment of band 10 with respect to said flue pipe is attained. In a similar manner, as fastener screws 19 are counter-rotated, the effective circumference of band 10 is progressively increased, so that band 10 is loosened with respect to said flue pipe, permitting slidable relocation of the present invention longitudinally along said flue pipe. In the event counterrotation of fastener screws 19 is continued until worm drive band fastener male ends 17 no longer mesh with worm drive fastener female ends 15, first end 13 and second end 14 may be separated, permitting the present invention to be removed from said flue pipe.

As depicted in FIGS. 1 and 2, thermostat bracket 20 having central air gap hole 21 and two mounting holes (not shown) is attached to exterior surface 12 at thermostat bracket attachment points 23. Thermostat bracket machine screws 25 are disposed through said mounting holes and secured to thermostat bracket 20 by first nuts 26, and spacers 27 are disposed between first nuts 26 and second nuts 28. Bimetal snap-disc thermostat 30 having snap-disc thermostat collar 31, two snap-disc thermostat holes (not shown), and thermostat electrical contacts 32 is disposed between second nuts 28 and third nuts 29, with thermostat bracket machine screws disposed through said snap-disc thermostat holes. The length of spacers 27 is chosen so that a small air passage 33 is present. In this manner, by removal of third nuts 29, snap-disc thermostat 30 may easily be removed in the event that maintenance is required. Snap-disc thermostat 30 is preferred to be of the SPST type, for instance as produced under the Therm-O-Disc brand name, with electrical connection between thermostat electrical contacts 32 occurring upon temperature rise to approximately 160 degrees Fahrenheit, and subsequent electrical disconnection between thermostat electrical contacts 32 occurring at approximately 140 degrees Fahrenheit. By selection of the preceding operational parameters for snap-disc thermostat 30, along with spacers 27 of approximately 0.25 inches in length and central air gap hole 21 of approximately one inch in diameter, thermal energy transfer from said flue pipe to band 10 and to snap-disc thermostat 30 will cause electrical connection between thermostat electrical contacts 32 when the present invention is attached to said flue pipe according to the parameters set forth below.

Also as shown in FIGS. 1 and 2 is generally L-shaped extension arm 40 having distal end 41, arcuate proximate end 42, test switch hole (not shown), and two distal end holes (not shown) is attached coplanarly and normally to band 10 at extension arm attachment points 43. Test switch 45 having test switch electrical contacts 46 and button 47 is disposed through said test switch hole and secured to extension arm 40 by washer 48 and test switch nut 49. Acoustic alarm 50 is of a well known type that provides a relatively loud sound, for instance as produced by Research Industries, Inc. under the brand name Lil Loudmouth, and has alarm bracket 51, adhesive mounting strip 52, horn 53, battery power supply 54 disposed within alarm bracket 51, and, as depicted schematically in FIG. 3, first and second alarm electrical contacts 71 and 72. Also as depicted schematically in FIG. 3, battery power supply 54 is electrically connected to horn 53 so that when electrical connection is made between first and second alarm electrical contacts 71 and 72, horn 53 is activated. L-shaped heat shield 58 having mount side 59, shield side 60, and two heat shield holes (not shown) alignable with said distal end holes, and electrical connection block 61 having terminals 62 and two connection block holes (not shown) alignable with said distal end holes are attached at distal end 41 by alarm bracket machine screws 63 disposed through said heat shield holes, said distal end holes and said connection block holes and fourth nuts 65. Heat shield 58 is thus disposed so that shield side 60 is interposed between alarm 50 and proximate end 42. In this manner, acoustic alarm 50 and battery power supply 54 are protected from damage due to high temperatures produced by said flue pipe by the effects of heat shield 58 and distance from band 10 provided by extension arm 40.

In the event that worm drive band fastener female and male ends 15 and 17 are formed of a material that may be welded, female and male ends 15 and 17 may be attached to band 10 by spot welding at female and male end attachment points 16 and 18. In the event that worm drive band fastener female and male ends are formed of a non-weldable material, female and male ends 15 and 17 may be attached to band 10 by a heat-resistant adhesive or other method that maintains as circular interior surface 11. In a similar manner, thermostat bracket 20 and extension arm 40 may be attached at thermostat bracket attachment points 23 and extension arm attachment points 43, respectively, by spot welding or with a heat-resistant adhesive.

Referring now to FIG. 3, thermostat electrical contacts 32 are electrically connected to first and second alarm electrical contacts 71 and 72 so that when electrical connection is made between thermostat electrical contacts 32 upon temperature rise, horn 53 is activated. Additionally, horn 53 may be activated for purposes of testing the operational status of battery power supply 54 and horn 53 by activating test switch 45, thereby completing electrical connection between test switch electrical contacts 46 as depicted in FIG. 3. In order to provide protection of electrical connections from damage due to elevated ambient temperatures, electrical connections may be made with heat resistant electrical wiring.

In operation, the present invention is typically slidably adjusted along said flue pipe to be disposed approximately twelve inches from said wood-burning or similar stove, so that for the operational parameters of snap-disc thermostat 30, the length of spacers 27 and the size of central air gap hole 21 set forth above, acoustic alarm 50 will remain unactivated while the temperature in said flue pipe proximate to the present invention is within or below normal operating range, but in the event the temperature in said flue pipe increases above normal operating range, acoustic alarm 50 is activated, providing an alert that a potentially dangerous condition is imminent. Depending upon variable parameters such as physical characteristics, age and condition of said flue pipe and said wood-burning or similar stove, physical environment in which said wood-burning or similar stove is placed, type of fuel used and the personal requirements of the user, the present invention may be slidably adjusted along said flue pipe to be relatively closer to or further from said wood-burning or similar stove, so that activation of acoustic alarm 50 is activated if and only if a dangerous condition is imminent. In addition, once activation of acoustic alarm 50 occurs, the present invention will continue to emit sound until action is taken that reduces the ambient temperature at snap-disc thermostat 30 by approximately twenty degrees Fahrenheit, at which temperature electrical disconnection between thermostat electrical contacts 32 occurs. As a result, the present invention may not be nondestructively deactivated without attention to the elevated temperature condition that caused activation of the present invention.

The present invention having been described in its preferred embodiments, it is clear that it is susceptible to numerous modifications and embodiments within the ability of those skilled in the art and without the exercise of the inventive faculty. Accordingly, the scope of the present invention is defined by the scope of the following claims.

What is claimed is:

1. Temperature alarm, adapted to be attached to a stove having a cylindrical flue pipe, comprising:

a generally circular heat conductive band having an interior surface, an exterior surface, a first end and a second end, disposed with said interior surface proximate to said flue pipe;

means for demountably and nonmagnetically attaching said band to said flue pipe so that said band may be longitudinally relocated along said flue pipe;

a sensor having a high temperature state in response to ambient temperature above a predetermined temperature;

means for attaching said sensor to said band so that said sensor is slightly displaced from said exterior surface;

an extension arm, having a proximate end and a distal end, attached at said proximate end to the exterior surface of said band;

alarm means, attached to the distal end of said extension arm;

power supply, attached to the distal end of said extension arm;

connection means between said sensor, said power supply and said alarm means, for activation of said alarm means in response to said high temperature state of said sensor; and heat shielding means interposed between the proximate end of said extension arm and said power supply and said alarm means.

2. Temperature alarm as defined in claim 1, wherein said sensor comprises a housing;

an electrical contact; and a bimetallic coil disposed within said housing, for closing said electrical contact in response to ambient temperature above said predetermined temperature; and said connection means comprises electrical connections between said electrical contact, said power supply and said alarm means.

3. Temperature alarm as defined in claim 2, wherein the distance between the first end and the second end of said band is greater than the circumference of said flue pipe, and said band is disposed surrounding said flue pipe.

4. Temperature alarm as defined in claim 3, wherein said means for demountably and nonmagnetically attaching said band to said flue pipe comprises a fastener attached between the first end and the second end of said band, disposed to provide tension urging the first end 5. Temperature alarm as defined in claim 4, wherein said extension arm is disposed coplanarly with and normal to said band.

6. Temperature alarm as defined in claim 5, wherein said heat shielding means is attached to said extension arm.

7. Temperature alarm as defined in claim 6, further comprising testing means for temporary connection of said alarm means to said power supply.

8. Temperature alarm, adapted to be attached to a stove having a cylindrical flue pipe, comprising:

a generally circular heat conductive band having an interior surface and an exterior surface, disposed with said interior surface proximate to said flue pipe;

means for demountably and nonmagnetically attaching said band to said flue pipe so that said band may be longitudinally relocated along said flue pipe;

a sensor having a high temperature state in response to ambient temperature above a first predetermined temperature, and a low temperature state in response to ambient temperature below a second predetermined temperature;

means for attaching said sensor to said band so that said sensor is slightly displaced from said exterior surface;

an extension arm, having a proximate end and a distal end, attached at said proximate end to the exterior surface of said band;

alarm means, attached to the distal end of said extension arm;

power supply, attached to the distal end of said extension arm;

connection means between said sensor, said power supply and said alarm means, for activation of said alarm means in response to said high temperature state of said sensor and for deactivation of said alarm means in response to said low temperature state of said sensor; and heat shielding means interposed between the proximate end of said extension arm and said power supply and said alarm means.

9. Temperature alarm as defined in claim 8, wherein: said sensor comprises a housing;

an electrical contact; and a bimetallic coil disposed within said housing, for closing said electrical contact in response to ambient temperature above said first predetermined temperature and for opening said electrical contact in response to ambient temperature below said second predetermined temperature; and said connection means comprises electrical connections between said electrical contact, said power supply and said alarm means.

10. Temperature alarm as defined in claim 8, further comprising testing means for temporary connection of said alarm means to said power supply.

11. Temperature alarm as defined in claim 8, wherein the distance between the first end and the second end of said band is greater than the circumference of said flue pipe, and said band is disposed surrounding said flue pipe.

12. Temperature alarm as defined in claim 11, wherein said means for demountably attaching said band to said flue pipe comprises a fastener attached between the first end and the second end of said band, disposed to provide tension urging the first end towards the second end.

13. Temperature alarm as defined in claim 8, wherein said extension arm is disposed coplanarly with and normal to said band.

14. Temperature alarm as defined in claim 13, wherein said heat shielding means is attached to said extension arm.

15. Temperature alarm, adapted to be attached to a stove having a cylindrical flue pipe, comprising:

a generally circular heat conductive band having a first end and a second end separated by a distance greater the circumference of said flue pipe, an interior surface and an exterior surface, disposed with said band surrounding said flue pipe and with the interior surface proximate to said flue pipe;

means for demountably and nonmagnetically attaching said band to said flue pipe so that said band may be longitudinally relocated along said flue pipe;

a housing;

an electrical contact;

a bimetallic coil disposed within said housing, for closing said electrical contact in response to ambient temperature above a first predetermined temperature and for opening said electrical contact in response to ambient temperature below a second predetermined temperature;

means for attaching said housing to said band so that said housing is slightly displaced from said exterior surface;

an extension arm, having a proximate end and a distal end, attached at said proximate end to the exterior surface of said band;

alarm means, attached to the distal end of said extension arm;

power supply, attached to the distal end of said extension arm;

connection means between said electrical contact, said power supply and said alarm means, for activation of said alarm means in response to closing of said electrical contact and for deactivation of said alarm means in response to opening of said electrical contact; and heat shielding means interposed between the proximate end of said extension arm and said power supply and said alarm means.

16. Temperature alarm as defined in claim 15, wherein said extension arm is disposed coplanarly with and normal to said band.

17. Temperature alarm as defined in claim 16, wherein said means for demountably and nonmagnetically attaching said band to said flue pipe comprises a fastener attached between the first end and the second end of said band, disposed to provide tension urging the first end towards the second end.

18. Temperature alarm as defined in claim 17, wherein said heat shielding means is attached to said extension arm.

19. Temperature alarm as defined in claim 18, further comprising testing means for temporary connection of said alarm means to said power supply.

* * * * *